US008899075B2

(12) United States Patent
Howard

(10) Patent No.: US 8,899,075 B2
(45) Date of Patent: Dec. 2, 2014

(54) AIR SEPARATION METHOD AND APPARATUS

(75) Inventor: Henry Edward Howard, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 685 days.

(21) Appl. No.: 12/949,337

(22) Filed: Nov. 18, 2010

(65) Prior Publication Data

US 2012/0125045 A1 May 24, 2012

(51) Int. Cl.
*F25J 3/00* (2006.01)
*F25J 3/04* (2006.01)

(52) U.S. Cl.
CPC ..... *F25J 3/04412* (2013.01); *F25J 3/0409* (2013.01); *F25J 3/04303* (2013.01); *F25J 3/04678* (2013.01); *F25J 3/04727* (2013.01); *F25J 2205/02* (2013.01)
USPC ..... 62/646; 62/643

(58) Field of Classification Search
USPC ..... 62/648, 640, 747, 644, 654, 924, 645, 62/647
See application file for complete search history.

(56) References Cited

U.S. PATENT DOCUMENTS

| | | | | |
|---|---|---|---|---|
| 4,935,044 | A | 6/1990 | Schoenpflug | |
| 5,019,145 | A | 5/1991 | Rohde et al. | |
| 5,463,871 | A * | 11/1995 | Cheung | 62/646 |
| 5,590,544 | A | 1/1997 | Corduan et al. | |
| 5,692,396 | A | 12/1997 | Rathbone | |
| 5,887,447 | A * | 3/1999 | Higginbotham | 62/643 |
| 5,970,743 | A | 10/1999 | Herron et al. | |
| 6,269,659 | B1 * | 8/2001 | De Bussy et al. | 62/648 |
| 6,574,988 | B1 | 6/2003 | Saulnier et al. | |
| 2009/0071191 | A1 * | 3/2009 | Rankin et al. | 62/652 |
| 2012/0036891 | A1 * | 2/2012 | Prosser et al. | 62/643 |

* cited by examiner

*Primary Examiner* — John F Pettitt
*Assistant Examiner* — Ignacio E Landeros
(74) *Attorney, Agent, or Firm* — Robert J. Hampsch

(57) ABSTRACT

A method and apparatus for separating air in which an argon refining column of a distillation column system is reboiled with a liquid air stream. The argon refining column further refines crude argon produced by a crude argon column connected to a lower pressure column of the distillation column system. At least one intermediate reflux stream is formed, at least indirectly, from at least part of the liquid air stream, and is introduced into the lower pressure column at a level thereof above where a crude liquid oxygen column bottoms of a higher pressure column of such system is further refined to increase a liquid to vapor ratio below said level and therefore, argon recovery from the argon refining column.

5 Claims, 2 Drawing Sheets

AIR SEPARATION METHOD AND APPARATUS

FIELD OF THE INVENTION

The present invention relates to an air separation method and apparatus in which air is cryogenically rectified in a distillation column system that has a crude argon column connected to a lower pressure column to produce a crude argon stream and an argon refining column connected to the crude argon column to produce an argon product stream. More particularly, the present invention relates to such a method and apparatus in which the argon refining column is reboiled with a liquid air stream that is utilized to produce intermediate reflux to a lower pressure column of the distillation column system to increase argon recovery.

BACKGROUND OF THE INVENTION

Air is separated by cryogenic rectification to produce oxygen, nitrogen and argon products. In a typical air separation plant the air is compressed to an elevated pressure (5 to 6 bara), pre-purified within a prepurification unit containing adsorbents and then cooled in a main heat exchanger to cryogenic temperatures that are suitable for the rectification of air within a system of distillation columns. The air after having been cooled is introduced into a higher pressure distillation column where the feed air is distilled into a nitrogen-rich vapor column overhead and an oxygen enriched bottoms liquid referred to in the art as kettle liquid or crude liquid oxygen. A crude liquid oxygen stream is subcooled, depressurized and fed to a lower pressure column that operates at a lower pressure than the higher pressure distillation column. In the lower pressure column, the crude liquid oxygen is further fractionated into an oxygen-rich liquid column bottoms and a nitrogen-rich vapor overhead.

Argon is a minor constituent of ambient air (0.93% dry basis) and can be recovered from the base double column system by extracting an oxygen-argon vapor stream from an intermediate location of the upper column near the base of the nitrogen stripping section. This stream is then directed to an argon rectification column, also known as a crude argon column, where a crude argon stream is produced as overhead. The condenser duty for the argon column is typically absorbed by the crude liquid oxygen stream prior to its introduction into the lower pressure distillation column.

Due to the fact that the oxygen-argon vapor stream is extracted from the lower pressure column near the base of the nitrogen stripping section it naturally contains trace levels of nitrogen. Since the nitrogen is more volatile than argon, it naturally accumulates in the argon-rich stream from the crude argon column. Air separation plants will incorporate a small distillation column designed to remove trace levels of light gases from the crude argon stream. This argon refining column typically employs both a condenser and a reboiler to effect the removal of light gases. In general, fluids derived from the higher pressure column are utilized to drive the reboil and condensation required of the argon refining column.

By way of Example, in U.S. Pat. No. 5,590,544, a compressed and purified air stream is cooled to near its dew point and introduced into a higher pressure column linked to a lower pressure column in a heat transfer relationship by a condenser reboiler. An argon oxygen containing vapor stream is taken from the lower pressure column and then rectified in a crude argon column. Crude argon vapor produced as column overhead is condensed to produce an argon containing reflux stream for the crude argon column and a crude argon stream. The crude argon stream is then rectified in a argon refining column to produce an argon product stream from resulting bottoms liquid. The condensation of the crude argon vapor produced in the crude argon column is accomplished through indirect heat exchange with a stream of crude liquid oxygen taken from the higher pressure column. This results in the partial vaporization of the crude liquid oxygen and the formation of liquid and vapor streams composed of resulting liquid and vapor phases that are returned to the lower pressure column for further refinement of the crude liquid oxygen. Reflux is produced for the argon refining column through indirect heat exchange with a liquid stream composed of the liquid phase resulting from the partial vaporization of the crude liquid oxygen. The argon refining column is reboiled either with the crude liquid oxygen or with part of the incoming air that has been cooled to near dew point temperature.

In general, argon recovery may be limited by any number of factors. For instance, argon recovery may be limited by the amount of vapor flow imparted through the base of the low pressure column by way of condensation of the nitrogen-rich vapor overhead produced in the higher pressure column through vaporization of the oxygen-rich liquid produced in the lower pressure column. Alternatively, the upper sections of the lower pressure column may possess insufficient reflux to adequately maintain a reflux ratio sufficient to trap most of the argon for recovery. The operation of the argon refining column often reduces the available reflux for the primary double column system given the fact that the crude liquid oxygen is partially vaporized in condensing the crude argon.

In many instances product oxygen composed of the oxygen-rich liquid produced in the lower pressure column is mechanically pumped to a high pressure and subsequently vaporized against condensing air. Such "liquid pumped" processes often suffer from low argon recovery. This is due in large part to the substantial reduction in high quality reflux flow available for the lower pressure column. In general, between about 30 and about 35 percent of the air may be liquefied for purposes of liquid oxygen pumping. Argon recovery decline is further amplified by the fact that liquid nitrogen and high pressure gaseous nitrogen production will also reduce the available reflux to the lower pressure column.

The production of liquefied air accompanying a liquid pumped cycle or a cycle which produces a large fraction of the feed air as a liquid product, either liquid oxygen and/or liquid nitrogen, is typically divided between both the higher and lower pressure nitrogen rectification sections. Typically, the liquid air is only partially subcooled within the main heat exchanger prior to depressurization and introduction into the distillation column system. Unfortunately, the resulting flash gas produced by throttling liquid air into the lower pressure column and/or higher pressure column results in a measurable decline in argon recovery.

As will be discussed, the present invention provides an air separation method and apparatus that among other advantages will increase the amount of reflux available in the lower pressure column and thereby increase the amount of argon being fed to the crude argon column to improve argon recovery. The method and apparatus of the present invention is particularly applicable to pumped liquid cycles, discussed above, to improve argon recovery.

SUMMARY OF THE INVENTION

The present invention provides, in one aspect, a method of separating air. In accordance with such method, the air is compressed and purified such that a first compressed air stream and a second compressed air stream are produced with the second compressed air stream having a higher pressure than the first compressed air stream. At least part of the first compressed air stream is cooled and the second compressed air stream is condensed through indirect heat exchange with return streams produced by a distillation column system. A refrigerant stream is produced and refrigeration is imparted, with the use of the refrigeration stream, into the distillation column system.

The at least part of the first compressed air stream is introduced into a higher pressure column of the distillation column system. The distillation column system also has a lower pressure column operatively associated with the higher pressure column in a heat transfer relationship, a crude argon column and an argon refining column. The crude argon column is connected to the lower pressure column to rectify an argon-oxygen containing vapor stream withdrawn from the lower pressure column to thereby, at least in part, produce a crude argon stream. The argon refining column rectifies the crude argon stream and thereby forms an argon product stream from an argon-rich liquid column bottoms produced in the argon refining column.

The argon refining column is reboiled with the liquid air stream, thereby subcooling the liquid air stream. At least one intermediate reflux stream, formed directly or indirectly from at least part of the liquid air stream after having been subcooled, is introduced into the lower pressure column at a level thereof above where all or any part of a crude liquid oxygen stream composed of a crude liquid oxygen column bottoms of the higher pressure column is introduced for further refinement. The intermediate reflux results in an increase in a liquid to vapor ratio below the level at which the crude liquid oxygen stream is introduced and therefore increasing the recoverable argon fraction from the argon contained in air.

The at least one intermediate reflux stream can be two intermediate reflux streams. In such case, the liquid air stream can be valve expanded and introduced into an intermediate location of the higher pressure column and constitutes a first of the two intermediate reflux streams. The second of the two reflux streams is formed from down coming liquid produced in the higher pressure column at the intermediate location and the second of the two intermediate reflux streams is withdrawn from the intermediate location of the higher pressure column and is valve expanded and introduced into the level of the lower pressure column. In an alternative embodiment where the at least one intermediate reflux stream is two intermediate reflux streams, such streams can be formed by dividing the liquid air stream into a first of the two intermediate reflux streams and a second of the two intermediate reflux streams. The first of the two intermediate reflux streams is valve expanded and introduced into an intermediate location of the higher pressure column and the second of the two intermediate reflux streams is valve expanded and introduced into the level of the lower pressure column.

A crude liquid oxygen stream, composed of the crude liquid oxygen, can be subcooled, valve expanded and passed in indirect heat exchange with an argon-rich vapor stream produced as argon refining column overhead in the argon refining column, thereby partially vaporizing the crude liquid oxygen stream and condensing the argon-rich vapor stream to produce a first argon-rich reflux stream. The first argon reflux stream is introduced into the argon refining column and first vapor and liquid phases of the crude liquid oxygen stream after having been partially vaporized are disengaged to produce a first vapor phase stream and a first liquid phase stream. Part of the first liquid phase stream is partially vaporized in indirect heat exchange with a crude argon-rich vapor stream, produced as a crude argon column overhead in the crude argon column, thereby partially vaporizing the first liquid phase stream into second liquid and vapor phases and condensing the crude argon-rich vapor stream. Part of the crude argon-rich vapor stream after having been condensed is introduced in the crude argon column as a second argon-rich reflux stream and another part of the crude argon-rich stream after having been condensed is valve expanded and forms the crude argon stream introduced into the argon refining column. A second liquid phase stream and a second vapor phase stream are formed from the second liquid and vapor phases, respectively. The second vapor phase stream is valve expanded, and introduced along with first vapor phase stream into the lower pressure column and the second liquid phase stream is introduced into the lower pressure column. Another part of the first liquid phase stream is valve expanded and is also introduced into the lower pressure column.

In another embodiment of the invention, the crude liquid oxygen stream can be subcooled and divided into first and second subsidiary crude liquid oxygen streams and the liquid air stream can be divided into first and second subsidiary liquid air streams. The first subsidiary liquid air stream is valve expanded and passed in indirect heat exchange with an argon-rich vapor stream produced as argon refining column overhead in the argon refining column, thereby vaporizing the first subsidiary liquid air stream and condensing the argon-rich vapor stream to produce a first argon-rich reflux stream. The first argon reflux stream is introduced into the argon refining column. The first subsidiary crude liquid oxygen stream is valve expanded and partially vaporized in indirect heat exchange with a crude argon-rich vapor stream, produced as a crude argon column overhead in the crude argon column, thereby partially vaporizing the first liquid phase stream into second liquid and vapor phases and condensing the crude argon-rich vapor stream. Part of the crude argon-rich vapor stream, after having been condensed, is introduced in the crude argon column as a second argon-rich reflux stream and another part of the crude argon-rich stream, after having been condensed, is valve expanded and forms the crude argon stream introduced into the argon refining column. A second liquid phase stream and a second vapor phase stream are formed from the second liquid and vapor phases, respectively and the second vapor phase stream is valve expanded, and introduced along with the first subsidiary liquid air stream, after having been vaporized and valve expanded, into the lower pressure column. The second liquid phase stream is introduced into the lower pressure column. The second subsidiary crude liquid oxygen stream is valve expanded and introduced into the lower pressure column and the at least one intermediate reflux stream is formed in part from the second liquid air stream.

In either of the embodiments, mentioned above, an oxygen-rich liquid column bottoms of the lower pressure column can be partially vaporized through indirect heat exchange with a higher pressure column nitrogen-rich vapor, thereby forming a liquid nitrogen stream. The liquid nitrogen stream is divided into first and second nitrogen-rich reflux streams, the first nitrogen-rich reflux stream is introduced into the higher pressure column as reflux and the second nitrogen-rich reflux stream is subcooled, valve expanded and introduced into the lower pressure column as reflux. The crude liquid oxygen stream and the second nitrogen-rich reflux stream are subcooled through indirect heat exchange with a waste nitrogen stream produced as lower pressure column overhead and the waste nitrogen stream is fully warmed. In this regard, the term "fully warmed" means warmed to a warm end temperature of the main heat exchanger used in cooling the air and warming the return streams produced by the distillation column system. An oxygen product stream composed of the oxygen-rich liquid column bottoms is pumped and then at least part of the oxygen product stream after having been pumped is fully warmed to produce an oxygen product and the return streams comprise the nitrogen-rich vapor stream and the oxygen product stream.

In any embodiment of the present invention, a first part of the first compressed air stream is fully cooled. It is to be noted that the term, "fully cooled" means cooled to a temperature at the cold end of a main heat exchanger utilized in cooling the at least part of the first compressed air stream and the condensing of the second compressed air stream. A second part of the first compressed air stream is partially cooled and then expanded in a turboexpander to produce the refrigeration stream from an exhaust of the turboexpander. The refrigeration stream is introduced into the lower pressure column. As used herein and in the claims, the term, "partially cooled" means cooled to an intermediate temperature, between the warm and cold end temperatures of the main heat exchanger discussed above.

In another aspect, the present invention provides an apparatus for separating air. In accordance with such aspect of the present invention, a main air compressor is provided for compressing the air and a purification system is connected to the main air compressor for purifying the air and thereby producing a compressed and purified air stream. A booster compressor is provided in flow communication with the purification unit such that a first compressed air stream is produced from at least part of the compressed and purified air stream and a second compressed air stream is produced by compressing another part of the compressed and purified air stream in the booster compressor. The second compressed air stream is compressed to a higher pressure than the first compressed air stream. A main heat exchanger is configured to cool at least part of the first compressed air stream and to condense the second compressed air stream and form a liquid air stream through indirect heat exchange with return product streams produced by a distillation column system. A means is also provided for imparting refrigeration into the distillation column system.

The distillation column system has a higher pressure column in flow communication with the main heat exchanger so as to receive the first compressed air stream and also, a lower pressure column, a crude argon column and an argon refining column. The lower pressure column is operatively associated with the higher pressure column in a heat transfer relationship and the crude argon column is connected to the lower pressure column to rectify an argon-oxygen containing vapor stream withdrawn from the lower pressure column and thereby, at least in part, produce a crude argon stream. The argon refining column rectifies the crude argon stream and thereby forms an argon product stream from an argon-rich liquid column bottoms produced in the argon refining column. The argon refining column has a bottom reboiler in flow communication with the main heat exchanger to receive the liquid air stream, thereby subcooling the liquid air stream and reboiling the argon refining column. A means is also provided for forming at least one intermediate reflux stream, directly or indirectly, from at least part from the liquid air stream after having been subcooled. The intermediate reflux forming means is connected to the lower pressure column at a level thereof above where all or any part of a crude liquid oxygen stream composed of a crude liquid oxygen column bottoms of the higher pressure column is introduced for further refinement.

The intermediate reflux forming means can comprise the at least one intermediate reflux stream formed by two intermediate reflux streams. In one embodiment, the reboiler is connected to the higher pressure column such that the liquid air stream is introduced into an intermediate location of the higher pressure column to form a first of the two intermediate reflux streams and the higher pressure column connected to the lower pressure column such that a second of the two intermediate reflux streams is formed from down coming liquid produced in the higher pressure column at the intermediate location. The second of the two intermediate reflux streams is discharged from the intermediate location of the higher pressure column and introduced into the level of the lower pressure column. Expansion valves are positioned between the higher pressure column and the reboiler such that the liquid air stream is valve expanded and also, between the higher pressure column and the lower pressure column such that the second of the two intermediate reflux streams is valve expanded prior to introduction into the location of the lower pressure column. In an alternative embodiment, the higher pressure column and the lower pressure column are connected to the reboiler such that a first of the two intermediate reflux streams is introduced into an intermediate location of the higher pressure column and a second of the two intermediate reflux streams is introduced into the level of the lower pressure column. In such embodiment, the expansion valves are also positioned between the higher pressure column and the reboiler such that the first of the two intermediate reflux streams is valve expanded prior to introduction into the higher pressure column and also, between the lower pressure column and the reboiler such that the second of the two intermediate reflux streams is valve expanded prior to introduction into the lower pressure column.

In a specific embodiment, a subcooling unit can be connected to the higher pressure column such that a crude liquid oxygen stream composed of the crude liquid oxygen is subcooled. A first heat exchanger is connected to the argon refining column and the subcooling unit such that the crude liquid oxygen stream is passed in indirect heat exchange with an argon-rich vapor stream produced as argon refining column overhead in the argon refining column, thereby partially vaporizing the crude liquid oxygen stream and condensing the argon-rich vapor stream to produce a first argon-rich reflux stream returned to the argon refining column as reflux. A phase separator is connected to the heat exchanger such that first vapor and liquid phases of the crude liquid oxygen stream after having been partially vaporized are disengaged to produce a first vapor phase stream and a first liquid phase stream. A second heat exchanger is connected to the crude argon column and the phase separator such that part of the first liquid phase stream is partially vaporized in indirect heat exchange with a crude argon-rich vapor stream produced as a crude argon column overhead in the crude argon column, thereby partially vaporizing the first liquid phase stream into second liquid and vapor phases and condensing the crude argon-rich vapor stream. Part of the crude argon-rich vapor stream after having been condensed is introduced in the crude argon column as a second argon-rich reflux stream. The argon refining column is connected to the second heat exchanger such that another part of the crude argon-rich stream after having been condensed is introduced into the argon refining column as the crude argon stream. The phase separator and the second heat exchanger connected to the lower pressure column such that a second liquid phase stream and a second vapor phase stream, formed from the second liquid and vapor phases, respectively, are introduced into the lower pressure column, the first vapor phase stream is introduced along with the second vapor phase stream into the lower pressure column and another part of the first liquid phase stream is introduced into the lower pressure column. The expansion valves are also positioned between: the first heat exchanger and the subcooling unit such that the crude liquid oxygen stream is valve expanded prior to entering the first heat exchanger; the phase separator and the lower pressure column such that first vapor phase stream is valve expanded prior to introduction into the lower pressure column; the phase separator and the lower pressure column such that the another part of the liquid phase stream is valve expanded prior to being introduced into the lower pressure column; and the second heat exchanger and the argon refining column such that the crude argon stream is valve expanded prior to being introduced into the argon column.

In an alternative embodiment, the subcooling unit is connected to the higher pressure column such that the crude liquid oxygen stream is subcooled. A first heat exchanger is connected to the argon refining column and to the reboiler such that a first subsidiary liquid air stream, composed of part of the liquid air stream, is passed in indirect heat exchange with an argon-rich vapor stream produced as argon refining column overhead in the argon refining column, thereby vaporizing the first subsidiary liquid air stream and condensing the argon-rich vapor stream to produce a first argon-rich reflux stream that is returned to the argon refining column. A second heat exchanger is connected to the crude argon column and to the subcooling unit such that a first subsidiary crude liquid oxygen stream, composed of the part of the crude liquid oxygen stream, is partially vaporized in indirect heat exchange with a crude argon-rich vapor stream produced as a crude argon column overhead in the crude argon column, thereby partially vaporizing the first liquid phase stream into second liquid and vapor phases and condensing the crude argon-rich vapor stream. Part of the crude argon-rich vapor stream after having been condensed is introduced in the crude argon column as a second argon-rich reflux stream. The argon refining column is connected to the second heat exchanger such that another part of the crude argon-rich stream after having been condensed forms the crude argon stream that is introduced into the argon refining column. The second heat exchanger is connected to the lower pressure column such that a second liquid phase stream and a second vapor phase stream, formed from the second liquid and vapor phases, respectively, are introduced into the lower pressure column.

The lower pressure column is also in flow communication with the first heat exchanger such that the first subsidiary liquid air stream, after having been vaporized, is introduced into the lower pressure column along with the second vapor phase stream. The lower pressure column is in flow communication with the subcooling unit such that a second subsidiary crude liquid oxygen stream, composed of another part of the crude liquid oxygen stream, is introduced into the lower pressure column. The intermediate reflux stream forming means is connected to the reboiler such that the at least one intermediate reflux stream is formed in part from the second liquid air stream. The expansion valves are also positioned between: the first heat exchanger and the reboiler such that the first subsidiary liquid air stream is valve expanded prior to entering the first heat exchanger; the first heat exchanger and the lower pressure column such that the first subsidiary liquid air stream, after having been vaporized, is valve expanded prior to entering the lower pressure column; the subcooling unit and the second heat exchanger such that the first subsidiary crude liquid oxygen stream is valve expanded prior to entering the second heat exchanger; the subcooling unit and the lower pressure column such that the second subsidiary crude liquid oxygen stream is valve expanded prior to entering the lower pressure column; and the second heat exchanger and the argon refining column such that the crude argon stream is valve expanded prior to entering the argon refining column.

In either of the two foregoing embodiments, a condenser reboiler is connected to the higher pressure column and the lower pressure column such that an oxygen-rich liquid column bottoms of the lower pressure column is partially vaporized through indirect heat exchange with a higher pressure column nitrogen-rich vapor, thereby forming a liquid nitrogen stream and first and second nitrogen-rich reflux streams composed of the liquid nitrogen stream. These streams are respectively introduced into the higher pressure column and the lower pressure column as reflux. The subcooling unit is connected to the higher pressure column and the lower pressure column such that the crude liquid oxygen stream and the second nitrogen-rich reflux stream are subcooled through indirect heat exchange with a waste nitrogen stream produced as lower pressure column overhead. The subcooling unit is also connected to the main heat exchanger such that the waste nitrogen stream is fully warmed and constitutes one of the return streams. A pump is positioned between the lower pressure column and the main heat exchanger such that an oxygen product stream composed of the oxygen-rich liquid column bottoms is pumped and then at least part of the oxygen product stream after having been pumped is fully warmed to produce an oxygen product and the oxygen product stream constitutes another of the return streams. The expansion valves are also positioned between the subcooling unit and the lower pressure column such that the second nitrogen reflux stream is valve expanded prior to entering the lower pressure column.

In any embodiment of the present invention, the refrigerant imparting means can comprise the main heat exchanger configured such that a first part of the first compressed air stream is fully cooled and constitutes the part of the first compressed air stream introduced into the higher pressure column. A second part of the first compressed air stream is partially cooled A turboexpander is positioned between the main heat exchanger and the lower pressure column such that the second part of the first compressed air stream is expanded to produce a refrigeration stream from an exhaust of the turboexpander and the refrigeration stream is introduced into the lower pressure column.

BRIEF DESCRIPTION OF THE DRAWINGS

While the present invention concludes with claims distinctly pointing out the subject matter that Applicant regards as his invention, it is believed the invention will be better understood when taken in connection with the accompanying drawings in which:

DETAILED DESCRIPTION

Figure 1:
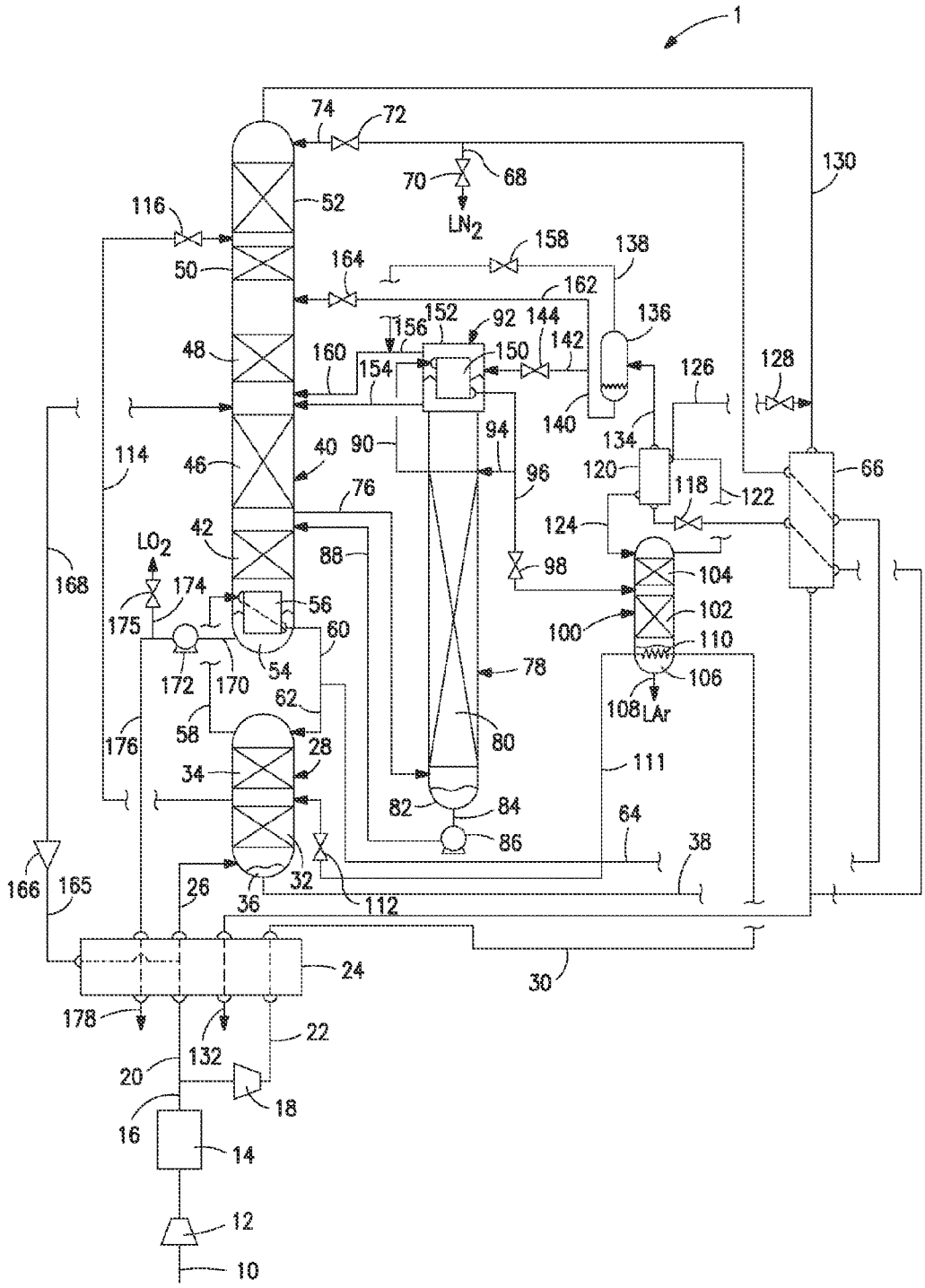
FIG. 1 is a schematic illustration of an apparatus for carrying out a method in accordance with the present invention.

With reference to FIG. 1, an air separation plant 1 is illustrated that constitutes an apparatus for separating a feed air stream 10 into its respective components. The feed air stream 10 is compressed in a main air compressor 12 and then purified within a purification system 14 connected to main air compressor 12 to produce a compressed and purified air stream 16. A booster compressor 18 is in flow communication with the purification unit 14 such that the compressed and purified air stream 16 is divided into a first compressed air stream 20 and a second compressed air stream 22 having a higher pressure than the first compressed air stream 20. Second compressed air stream 22 constitutes between 25 and 40 percent of the total air entering the plant.

It is to be pointed out that main compressor 12 and booster compressor 18 can be multi-stage, intercooled integral gear compressors with condensate removal between stages. Both such compressors have, in addition to the intercooling, an after-cooler, not illustrated, for removing the heat of compression. The purification unit 14 is designed to remove higher boiling impurities from the air such as water vapor, carbon dioxide and hydrocarbons. As well known in the art and as discussed above, such purification unit 14 can incorporate adsorbent beds operating in an out of phase cycle that is a temperature swing adsorption cycle or a pressure swing adsorption cycle or combinations thereof.

Briefly, the first compressed air stream 20 and the second compressed air stream 22 are introduced into a main heat exchanger 24. Main heat exchanger 24 can be of brazed aluminum fin construction and, although not illustrated, can be a series of such heat exchangers operated in parallel. In the illustrated embodiment, a part 26 of the first compressed air stream 20 is fully cooled and introduced into a higher pressure distillation column 28 of a distillation column system. It is to be noted, however, that there exist air separation plants in which a stream, such as part 26 of the first compressed air stream 20 is not fully cooled within a main heat exchanger, but rather, is partially cooled, expanded and then introduced into the higher pressure distillation column. The distillation column system also has a lower pressure column 40 in a heat transfer relationship with the higher pressure distillation column 28, a crude argon column 78 to rectify an argon-oxygen containing stream 76 to produce a crude argon stream 96 that is further refined in an argon refining column 100 to produce an argon product stream 108, labeled "LAr". The crude argon column refines the argon oxygen containing stream 76 so as to deplete oxygen from such stream and the refining column 100 removes nitrogen and other possible residual light gases from the crude argon stream. The second compressed air stream 22 is liquefied within main heat exchanger 24 to produce a liquid air stream 30. Liquid air stream 30 will preferably have a temperature range from between 98 K and 105 K. The liquid air stream is subcooled within reboiler 110 which resides at the base of argon refining column 100. The subcooled liquid air is then used to produce at least an intermediate reflux stream 114 that is introduced to the lower pressure column 40 to increase the recoverable fraction of argon contained in argon oxygen containing stream 76 that serves as a feed to the crude argon column 78.

A more detailed explanation begins with higher pressure distillation column 28 that operates at a pressure of between 5 and 6 bara. The introduction of compressed air stream 26 initiates the formation of an ascending vapor phase that becomes ever more rich in nitrogen as it ascends higher pressure distillation column 28 and through mass transfer contacting elements 32 and 34 that can be trays or structured packing or a combination of trays or structure packing or possibly random packing. As a result, a nitrogen-rich vapor column overhead is produced within the higher pressure distillation column 28 that is condensed to initiate the formation of a descending liquid phase that contacts the ascending vapor phase passing through mass transfer contacting elements 32 and 34 to become ever more rich in oxygen and thereby to produce a crude liquid oxygen column bottoms 36, also known in the art as kettle liquid. In a manner that will be discussed, the crude liquid oxygen column bottoms 36 is removed as a crude liquid oxygen stream 38 that is further refined in the lower pressure distillation column 40.

Lower pressure distillation column 40 has mass transfer contacting elements 42, 46, 48, 50 and 52 that function to contact an ascending vapor phase with a descending liquid phase and can be trays, structured packing or random packing or combinations thereof. As a result, an oxygen-rich liquid column bottoms 54 is produced along with a nitrogen-rich vapor column overhead stream 130. The lower pressure distillation column 40 is linked to the higher pressure distillation column 28 in a heat transfer relationship by means of a condenser reboiler 56. Condenser reboiler 56 serves to condense a nitrogen-rich vapor stream 58 taken from higher pressure column 28 overhead. A portion of the down coming liquid in the lower pressure distillation column 40 is vaporized in condenser reboiler 56 to produce boilup in the lower pressure distillation column 40 and a nitrogen-rich liquid stream 60. The oxygen-rich liquid column bottoms 54 is thus, residual liquid that is not vaporized. Condenser reboiler 56 can be a conventional thermo-siphon type heat exchanger or a falling film, down-flow type heat exchanger. The nitrogen-rich liquid stream 60 is divided into a first nitrogen reflux stream 62 that is returned to the higher pressure distillation column 28 as reflux for such column and a second nitrogen reflux stream 64. Second nitrogen reflux stream 64 is subcooled within subcooling unit 66. In the illustrated embodiment a part 68 of the second nitrogen reflux stream 64 can be valve expanded in an expansion valve 70 and taken as a liquid nitrogen product "$LN_2$" and the remainder can be valve expanded in an expansion valve 72 and introduced into the lower pressure column 40 as a stream 74. As would be known, all of such second reflux stream 64 could be valve expanded and used to reflux the lower pressure distillation column 40.

An argon oxygen containing stream 76 is withdrawn from the lower pressure column 40 and introduced into a crude argon column 78 having mass transfer contacting elements 80 of the type discussed above. Crude argon column 78 will typically employ between 50 and 180 stages and operates at a pressure comparable to that of the lower pressure column 40. The argon oxygen containing stream 76 is rectified in the crude argon column 78 to produce a crude argon-rich vapor as column overhead and an oxygen containing column bottoms 82. A stream 84 composed of the oxygen containing column bottoms 82 is pumped by a pump 86 and returned to the lower pressure column 40 as a stream 88. The pump 86 is necessary to motivate the liquid back to the appropriate feed location of the lower pressure column 40. Depending on the height of the distillation column system a pump could likewise be required for motivating other liquid streams such as the crude liquid oxygen stream 38.

A crude argon-rich vapor stream 90 is condensed in a heat exchanger 92. Part of the resulting condensate is introduced as reflux into the crude argon column 78 as an argon-rich reflux stream 94 and another part of the condensate forms a crude argon stream 96. Crude argon stream 96 will be pressurized by gravitation head as it descends and will typically contain between 10 and 10,000 ppm nitrogen and trace quantities of other light gases. Crude argon stream 96 is let down in pressure by an expansion valve 98 and introduced into an argon refining column 100 for further refinement. Argon refining column 100 can operate at a pressure of about 30 psia. However, with liquid air reboil of the argon refining column 100, operational pressures of 60 psia are possible. Argon refining column 100 has mass transfer contacting elements 102 and 104 of the type discussed above and the crude argon stream 96 is rectified within such column to produce an argon-rich liquid column bottoms 106 that is reboiled. An argon product stream 108 is formed from argon-rich liquid column bottoms 106 to form a liquid argon product "LAr".

Embodiments of the present invention are possible in which the crude argon stream to be further processed within the argon refining column 100 is a vapor rather than a liquid. Furthermore, the purity of the crude argon stream 96 is dependent upon the level of staging within crude argon column 78. If necessary, warm or super ambient temperature argon refining may be employed. For example, where the crude argon stream 96 contains between 0.01 and 2 percent oxygen, catalytic combustion with hydrogen, adsorption or regenerative gettering can be employed. In such systems, the deoxygenated crude argon stream would be dried and cooled to saturation and then fed to the refining column 100. In such case, the crude argon stream 96 is formed in part by the crude argon column 78 and in part by the catalytic combustion and etc. Additionally, where catalytic combustion is used, the argon refining column will also remove residual hydrogen that would be contained in such crude argon stream.

The argon refining column 100 is reboiled by passing the liquid air stream 30 through a reboiler 110 situated in a bottom region of the argon refining column 100. This subcools the liquid air stream 30 to produce a subcooled liquid air stream 111 that is let down in pressure to the higher pressure column 28 by an expansion valve 112 and introduced into the higher pressure column 28 as intermediate reflux. The subcooled liquid air stream 111 constitutes a first intermediate reflux stream. A second intermediate reflux stream 114, formed from down coming liquid within the higher pressure column 28, is let down in pressure by an expansion valve 116 and introduced as intermediate reflux into the lower pressure column 40. Second intermediate reflux stream 114 is introduced into a level of the lower pressure column 40 above where the crude liquid oxygen or any part thereof is introduced for further refinement. The effect of this is to increase the liquid to vapor ratio below such level and therefore, increase the recoverable argon fraction from stream 76. As a result, the recovery of the argon contained in the argon product stream 108 is increased.

Subcooled liquid air stream 111 is introduced at an interstage location of column 28. Descending liquid from upper section 34 of column 28 will naturally have an oxygen content comparable to that of stream 111. This descending liquid and the liquid fraction of stream of 111 are combined to form a liquid reflux stream that transits section 32 of column 28. As a consequence of this fact, liquid stream 114 can be alternatively derived from the liquid descending/down-coming from section 34 of column 28. Liquid stream 114 can be extracted from column 28 in lieu of extracting/splitting a portion of stream 111 prior to introduction into column 28. As such, the presence of liquid air stream 111 indirectly enables the formation of stream 114.

Figure 2:
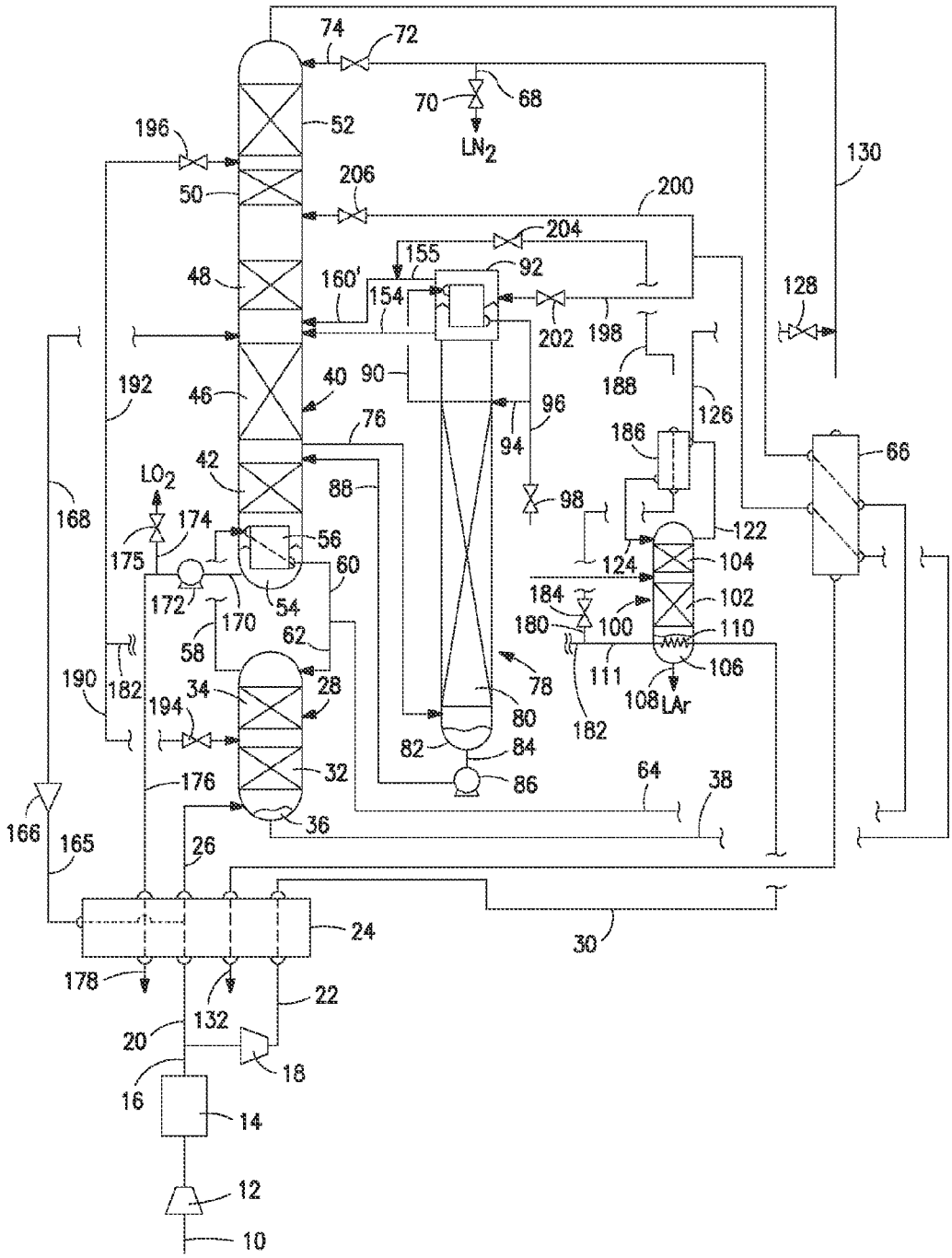
FIG. 2 is an alternative embodiment of FIG. 1.

The crude liquid oxygen stream 38 is subcooled within subcooling unit 66, valve expanded by an expansion valve 118 and then introduced into a heat exchanger 120. Subcooling unit 66 can be a brazed aluminum plate-fin heat exchanger of known design. The crude liquid oxygen stream 38 is partially vaporized within the heat exchanger 120 through indirect heat exchange with an argon-rich vapor stream 122 produced as an argon refining column overhead in the argon refining column 100. The argon-rich vapor stream 122 is condensed to produce an argon reflux stream 124 that is introduced as reflux into the argon refining column 100. Preferably the heat exchanger 120 and a heat exchanger 186 to be discussed hereinafter with respect to FIG. 2 are designed in a known manner to produce a vent gas stream 126 from vapor that is not condensed within such heat exchangers. The vent gas stream will contain at least nitrogen and argon. In the illustrated embodiment, the vent gas stream 126 is let down in pressure by an expansion valve 128 and combined with a waste nitrogen stream 130 produced in lower pressure column 40 as column overhead. Alternatively, vent gas stream 126 could be directed to a suitable location of the lower pressure column 40 or could simply be vented. The waste nitrogen stream 130, either alone or combined with the vent gas stream 126, passes through the subcooling unit 66 for subcooling duty and then is fully warmed within the main heat exchanger 24 and is discharged as a warm waste nitrogen stream 132. Waste nitrogen stream 130 is thus a return stream from the cryogenic rectification process conducted in air separation plant 1 and serves to cool the first compressed air stream 20 and the second compressed air stream 22.

A partially vaporized crude liquid stream oxygen stream 134, resulting from the partial vaporization of the crude liquid oxygen stream 38 within heat exchanger 120, is introduced into a phase separator 136 where vapor and liquid phases thereof are disengaged to produce a vapor phase stream 138 and a liquid phase stream 140. A part 142 of the liquid phase stream 140 is depressurized by an expansion valve 144 and introduced into a heat exchanger 92 in which the part 142 of the liquid phase stream 140 is passed in indirect heat exchange with a crude argon-rich vapor stream 90 produced as column overhead in the crude argon column 78. It is to be noted here that it is possible that in lieu of an expansion valve 144, vessels 136 and 92 could be operated at a comparable pressure which would allow a direct piped connection. In the illustrated embodiment, the crude argon-rich vapor stream 90 passes through a heat exchanger core 150 housed within a shell 152 of the heat exchanger 146. Heat exchanger core 150 can be of known brazed aluminum plate fin construction. The part 142 of the liquid phase stream 140 thereby partially vaporizes and the crude argon-rich vapor stream 90 is substantially condensed to produce the argon-rich reflux stream 94 and the crude argon stream 96, discussed above.

Liquid and vapor phases are produced within the heat exchanger 92 through the partial vaporization of part 142 of the liquid phase stream 140. Liquid and vapor phase streams 154 and 156 are thereby formed from such partial vaporization. The liquid phase stream 154 is introduced into the lower pressure column 40 and the vapor phase stream 156 is combined with vapor phase stream 138 discharged from phase separator 136, after the vapor phase stream 138 has been valve expanded in an expansion valve 158, to produce a combined vapor phase stream 160. Combined vapor phase stream 160 is introduced into the lower pressure column 40 at the same point as the liquid phase stream 154. As can be appreciated, vapor phase stream 138 and vapor phase stream 156 could be separately introduced into the lower pressure column 40. A remaining part 162 of the liquid phase stream 140 is valve expanded in an expansion valve 164 and introduced into the lower pressure column 40.

Other embodiments are possible in connection with the condensation of the crude argon-rich vapor stream 90 and the argon-rich vapor stream 122. The approximate duty of the heat exchanger 120 is only about $1/40^{th}$ of that of heat exchanger 92. Given this, it is possible that the crude liquid oxygen stream 38 after having been subcooled could be split into three fractions. One fraction would proceed to an upper location of the lower pressure column 40, a second fraction to the heat exchanger 92 and a third fraction to the heat exchanger 120. Given the small level of evaporation necessary, the inclusion of a phase separator 136 is optional. It should also be noted that a phase separator could be positioned after expansion valve 118 to enable more effective liquid and vapor distribution within the heat exchanger 120.

In the illustrated embodiment, refrigeration is imparted by discharging a part 165 of the first compressed air stream 20 from the main heat exchanger 24 after the first compressed air stream 20 has been partially cooled. Part 165 of the first compressed air stream 20 constitutes between 5 and 15 percent of the first compressed air stream 20. Part 165 of the first compressed air stream 20 is then expanded within a turboexpander 166 to produce an exhaust stream 168 having a pressure in a range of between 1.1 and 1.5 bara. Exhaust stream 168 is introduced into the lower pressure column 40 in order to impart refrigeration into the air separation plant 1. It is to be noted that the work of expansion may be employed for other compression service or used to generate electric power. There are alternative refrigeration generation techniques that could be used in connection with the present invention. For example, a portion of the nitrogen-rich vapor stream 58 could be warmed and then expanded in a turboexpander and then further warmed within the main heat exchanger 24. Another alternative is to turboexpand the waste nitrogen stream 130 after having been partly warmed within the main heat exchanger 24 and the resulting exhaust could then be fully warmed within the main heat exchanger to impart refrigeration. A yet other option is to externally produce a refrigerant stream.

Air separation plant 1 is designed to produce an oxygen product at pressure. For such purposes, an oxygen product stream 170 composed of the oxygen-rich liquid column bottoms 54 is extracted from the lower pressure column 40 and pumped by a pump 172. Part 174 of the oxygen product stream 170, after having been pumped can be directly taken as a pressurized liquid oxygen product "LO2" after having been reduced in pressure by an expansion valve 175. Another part 176 of the oxygen product stream 170 after having been pumped can be fully warmed within the main heat exchanger 24 to produce a pressurized oxygen product stream 178. As could be appreciated all of the oxygen product stream 170 after having been pumped could be taken as a pressurized oxygen product stream 178. As would be known to those skilled in the art, heat exchange primarily between the oxygen product stream 170 and the second compressed air stream 22 produces the liquid air stream 30. However, a liquid air stream could also be produced by pumped vaporization of liquid nitrogen in a plant that required production of nitrogen at pressure. Also, a process with a high liquid product fraction will often utilize an air liquefaction stream to thermally balance the cold end of the main heat exchanger 24. In such case, the air is liquefied against streams undergoing sensible warming. Furthermore, if second compressed air stream 22 is at a sufficient pressure, the resulting liquid air stream could be expanded in a liquid turbine to also generate refrigeration.

With additional reference to FIG. 2, liquid air stream 30 serves as both the working fluid for condensing overhead and for reboiling argon refining column 100. In this embodiment, the subcooled liquid air stream 111 is divided into first and second subsidiary liquid air streams 180 and 182. The first subsidiary liquid air stream 180 is valve expanded in an expansion valve 184 and introduced into a heat exchanger 186 where it indirectly exchanges heat with the argon-rich vapor stream 122. The argon-rich vapor stream 122 is condensed to produce the argon reflux stream 124 and the first subsidiary liquid air stream 180 is vaporized to produce a vaporized air stream 188 for purposes that will be discussed hereinafter. The second subsidiary liquid air stream 182 is divided into two intermediate reflux streams 190 and 192. Intermediate reflux stream 190 is valve expanded in an expansion valve 194 and introduced into the higher pressure column 28 as intermediate reflux and intermediate reflux stream 192 is valve expanded in an expansion valve 196 and introduced into the lower pressure column 40 for purposes of increasing argon production. It is to be noted that in the embodiment of the present invention shown in FIG. 1, the subcooled liquid air stream 111 could be divided into two intermediate reflux streams in a like manner to that of FIG. 2. Alternatively, the intermediate reflux streams utilized in FIG. 2 could be produced in the same manner as that shown in connection with FIG. 1. It is to be noted, that although two intermediate reflux streams 111 and 114 are used in the FIG. 1 embodiment and two intermediate reflux streams 190 and 192 are used in the FIG. 2 embodiment, it is possible that only one of such intermediate reflux streams would be produced and, in such case, the one intermediate reflux stream would be introduced into the lower pressure column 40.

The crude liquid oxygen stream 38, after having been subcooled within subcooling unit 66 is divided into first and second subsidiary crude liquid oxygen streams 198 and 200. The first subsidiary crude liquid oxygen stream 198 is valve expanded in an expansion valve 202 and introduced into the heat exchanger 92 to produce the liquid and vapor phase streams 155 and 156. In such embodiment, the vaporized air stream 188 is valve expanded in an expansion valve 204 and then combined with the vapor phase stream 155 to produce a combined stream 160'. The second subsidiary crude liquid oxygen stream 200 is valve expanded in an expansion valve 206 and introduced into the lower pressure column 40.

While the present invention has been shown and described in connection with preferred embodiments, as would occur to those skilled in the art that numerous changes, additions and omission could be made without departing from the spirit and scope of the invention as set forth in the appended claims.

I claim:

1. A method of separating air comprising:

compressing and purifying the air such that a first compressed air stream and a second compressed air stream are produced, the second compressed air stream having a higher pressure than the first compressed air stream;

cooling at least part of the first compressed air stream and condensing the second compressed air stream through indirect heat exchange with return streams produced by a distillation column system to form a liquid air stream;

producing a refrigerant stream and imparting refrigeration with the use of the refrigeration stream into the distillation column system;

introducing the at least part of the first compressed air stream into higher pressure column of the distillation column system, the distillation column system also having a lower pressure column operatively associated with the higher pressure column in a heat transfer relationship, a crude argon column connected to the lower pressure column to rectify an argon-oxygen containing vapor stream withdrawn from the lower pressure column to thereby, at least in part, produce a crude argon stream and an argon refining column to rectify the crude argon stream and thereby form an argon product stream from an argon-rich liquid column bottoms produced in the argon refining column;

reboiling the argon refining column with the at least a portion of liquid air stream, thereby subcooling the liquid air stream; and introducing at least one intermediate reflux stream, formed indirectly from at least part of the liquid air stream after having been subcooled, into the lower pressure column at a level thereof above where all or any part of a crude liquid oxygen stream composed of a crude liquid oxygen column bottoms of the higher pressure column is introduced for further refinement.

2. The method of claim 1, wherein:

the at least one intermediate reflux stream is two intermediate reflux streams;

the liquid air stream is valve expanded and introduced into an intermediate location of the higher pressure column and constitutes a first of the two intermediate reflux streams;

a second of the two reflux streams is formed from down coming liquid produced in the higher pressure column at the intermediate location; and the second of the two intermediate reflux streams is withdrawn from the intermediate location of the higher pressure column and is valve expanded and introduced into the level of the lower pressure column.

3. The method of claim 1, wherein:

a crude liquid oxygen stream composed of the crude liquid oxygen is subcooled, valve expanded and passed in indirect heat exchange with an argon-rich vapor stream produced as argon refining column overhead in the argon refining column, thereby partially vaporizing the crude liquid oxygen stream and condensing the argon-rich vapor stream to produce a first argon-rich reflux stream;

the first argon reflux stream is introduced into the argon refining column;

first vapor and liquid phases of the crude liquid oxygen stream after having been partially vaporized are disengaged to produce a first vapor phase stream and a first liquid phase stream;

part of the first liquid phase stream is partially vaporized in indirect heat exchange with a crude argon-rich vapor stream produced as a crude argon column overhead in the crude argon column, thereby partially vaporizing the first liquid phase stream into second liquid and vapor phases and condensing the crude argon-rich vapor stream;

part of the crude argon-rich vapor stream after having been condensed is introduced in the crude argon column as a second argon-rich reflux stream and another part of the crude argon-rich stream after having been condensed is valve expanded and forms the crude argon stream introduced into the argon refining column;

a second liquid phase stream and a second vapor phase stream are formed from the second liquid and vapor phases, respectively;

the second vapor phase stream is introduced along with first vapor phase stream into the lower pressure column;

the second liquid phase stream is introduced into the lower pressure column; and another part of the first liquid phase stream is valve expanded and introduced into the lower pressure column.

4. The method of claim 3, wherein:

an oxygen-rich liquid column bottoms of the lower pressure column is partially vaporized through indirect heat exchange with a higher pressure column nitrogen-rich vapor, thereby forming a liquid nitrogen stream;

the liquid nitrogen stream is divided into first and second nitrogen-rich reflux streams;

the first nitrogen-rich reflux stream is introduced into the higher pressure column as reflux;

the second nitrogen-rich reflux stream is subcooled, valve expanded and introduced into the lower pressure column as reflux;

the crude liquid oxygen stream and the second nitrogen-rich reflux stream are subcooled through indirect heat exchange with a waste nitrogen stream produced as lower pressure column overhead;

the waste nitrogen stream is fully warmed;

an oxygen product stream composed of the oxygen-rich liquid column bottoms is pumped and then at least part of the oxygen product stream after having been pumped is fully warmed to produce an oxygen product; and the return streams comprised the nitrogen-rich vapor stream and the oxygen product stream.

5. The method of claim 1, wherein:

a first part of the first compressed air stream is fully cooled;

a second part of the first compressed air stream is partially cooled and then expanded in a turboexpander to produce the refrigeration stream from an exhaust of the turboexpander; and the refrigeration stream is introduced into the lower pressure column.

* * * * *